US011682273B2

(12) United States Patent
Destrian et al.

(10) Patent No.: US 11,682,273 B2
(45) Date of Patent: Jun. 20, 2023

(54) ATTACHMENT SYSTEM FOR ATTACHMENT TO A SIGNALING DEVICE, AND ASSOCIATED SIGNALING SYSTEM

(71) Applicant: INTELLINIUM, Aix en Provence (FR)

(72) Inventors: Mathieu Destrian, Carry-le-Rouet (FR); Pierre Luc Maumi, Marseilles (FR); Guillaume Terrien, Allauch (FR)

(73) Assignee: INTELLINIUM, Aix en Provence (FR)

( * ) Notice: Subject to any disclaimer, the term of this patent is extended or adjusted under 35 U.S.C. 154(b) by 0 days.

(21) Appl. No.: 17/683,200

(22) Filed: Feb. 28, 2022

(65) Prior Publication Data

US 2022/0189259 A1 Jun. 16, 2022

Related U.S. Application Data

(63) Continuation of application No. PCT/FR2020/051509, filed on Aug. 28, 2020.

(30) Foreign Application Priority Data

Aug. 28, 2019 (FR) ..... 19/09444

(51) Int. Cl.
*G08B 5/00* (2006.01)
*F21V 19/00* (2006.01)
(Continued)

(52) U.S. Cl.
CPC ..... *G08B 5/006* (2013.01); *E01F 9/615* (2016.02); *F21V 19/004* (2013.01); *F21V 19/02* (2013.01); *F21V 21/06* (2013.01); *F21V 33/0076* (2013.01)

(58) Field of Classification Search
CPC ..... G08B 5/006; F21V 19/004; F21V 19/02; F21V 21/06; F21V 33/0076; E01F 9/654; E01F 9/615
(Continued)

(56) References Cited

U.S. PATENT DOCUMENTS 3,732,842 A 5/1973 Vara, Sr.
5,467,548 A * 11/1995 Ross ..... E01F 13/022 404/9
(Continued)

FOREIGN PATENT DOCUMENTS

KR 101884461 8/2018
WO 1999033526 7/1999

OTHER PUBLICATIONS

International Search Report for International Application No. PCT/FR2020/051509, dated Nov. 16, 2020.

*Primary Examiner* — Laura K Tso
(74) *Attorney, Agent, or Firm* — Burris Law, PLLC

(57) ABSTRACT

An attachment system for attachment to a signaling device includes an attachment member. The attachment member is formed of a ring-shape made of an elastic material and includes an annular base and at least one fin. The annular base includes an external peripheral edge and a central orifice defining an internal peripheral edge. The annular base also includes an annular lower face and an annular upper face. The fin projects from the external peripheral edge of the annular base. The attachment member is movable between a rest configuration in which the annular base is planar and extends in a main plane to allow insertion and positioning on the signaling device at a selected position, and a deformed configuration in which the annular base is non-planar in a deformed state in order to be able to match a peripheral area of the signaling device.

18 Claims, 4 Drawing Sheets

(51) Int. Cl.

| | |
|---|---|
| ***F21V 19/02*** | (2006.01) |
| ***F21V 21/06*** | (2006.01) |
| ***E01F 9/615*** | (2016.01) |
| ***F21V 33/00*** | (2006.01) |

(58) Field of Classification Search
USPC ..... 362/257, 396; 116/63 C, 63 P
See application file for complete search history.

(56) References Cited

U.S. PATENT DOCUMENTS

| | | | | |
|---|---|---|---|---|
| 5,577,824 | A * | 11/1996 | Wright | F21S 9/02 340/908 |
| 6,527,245 | B2 * | 3/2003 | Graves | E01F 9/669 248/528 |
| 7,997,764 | B1 * | 8/2011 | Nielson | E01F 9/688 362/183 |
| 8,602,584 | B2 * | 12/2013 | Ghafoori | H05B 47/155 362/186 |
| 8,777,512 | B2 | 7/2014 | Henderson | |
| 2002/0159251 | A1 * | 10/2002 | Hart | F21S 9/037 362/311.06 |
| 2012/0186511 | A1 | 7/2012 | Spray | |
| 2019/0177934 | A1 | 6/2019 | Mueller et al. | |
| 2019/0259256 | A1 * | 8/2019 | Fairweather | E01F 9/654 |

* cited by examiner

ATTACHMENT SYSTEM FOR ATTACHMENT TO A SIGNALING DEVICE, AND ASSOCIATED SIGNALING SYSTEM

CROSS-REFERENCE TO RELATED APPLICATIONS

This application is a continuation of International Application No. PCT/FR2020/051509, filed on Aug. 28, 2020, which claims priority to and the benefit of FR 19/09444 filed on Aug. 28, 2019. The disclosures of the above applications are incorporated herein by reference.

FIELD

The present disclosure relates to an attachment system for attachment to a signaling device, such as a signaling beacon (for example of the type signaling cone or cylindrical signaling beacon) or such as a signaling barrier.

BACKGROUND

The statements in this section merely provide background information related to the present disclosure and may not constitute prior art.

The present disclosure pertains to the field of signaling devices, and in particular signaling barriers as well as signaling beacons standardized in the European standard EN 13422 (signaling or traffic cones and cylindrical beacons).

In general, these barriers and these beacons are orange or white with reflective strips.

Such signaling barriers are used to visually close and delimit an access, in particular an access to a lane or to an access ramp, and they are thus movable between a closed position and an open position, generally by pivoting while being raised and lowered. These signaling barriers having generally a cylindrical or polygonal section.

Such signaling beacons are used as beaconing in order to visually delimit areas whose access is temporarily forbidden, and for example on roads and highways, in construction sites and also in industrial sites to mark out, signal or close access to dangerous areas, as well as for example crime and investigation sites. Beacons may be used individually or in multiple.

The signaling beacons may also be used to protect workers on traffic lanes (for example roads or highways) by putting them in the form of a cone barrier perpendicular to the alignment, beveled or longitudinal with respect to the alignment.

Finally, the signaling beacons are also commonly used to identify a specific danger, usually temporary. This may be, for example, a hole in the ground that is difficult to see.

These signaling beacons generally comprise a hollow body with a frustoconical or cylindrical shape that terminates in a support base on the ground, and they are often aligned to the ground, at more or less regular intervals and over a larger or shorter length.

The ease of use and the low cost of these signaling beacons have allowed generalization thereof. However, it rapidly become desired to add one or more additional elements to the signaling beacons, and this without having to modify the physical structure.

In a known manner, for example from the documents US2012/0186511, U.S. Pat. No. 8,777,512, WO99/33526, U.S. Pat. No. 8,777,512 and US2019/0177934, there is provided an attachment member for attachment to a signaling beacon, in order to fasten to the signaling beacon an additional element such as one or several flag(s) or hooking rings in order to hook flexible cables.

In the documents U.S. Pat. No. 8,777,512, WO99/33526, U.S. Pat. No. 8,777,512 and US2019/0177934, the attachment member is in the form of an annular body, generally frustoconical, which is made of a rigid material and which is fitted and slid around the signaling beacon, while being based on a retention by gravity so that the attachment member is put in place and remains there. Yet, it comes out that such attachment members represent a danger for users, in particular during an impact between a vehicle and the signaling beacon on which an attachment member is mounted. Indeed, during such an impact, this attachment member is likely to be separated from the signaling beacon when the latter tips over following contact with the vehicle. The resulting risk is to see the attachment member being thrown into the air and thus to behave like a high-velocity rigid projectile, or to see the attachment member rolling on the ground and thus forming a rigid member over which a vehicle is likely to roll.

In the document US2012/0186511, the attachment member is in the form of a frustoconical part, provided with two rings which may be in a flexible material such as rubber. The attachment member, due to its frustoconical configuration, is particularly difficult to place around the signaling beacon, because the latter offers a large conical inner surface which comes into contact with the signaling beacon and which therefore hinders its insertion. Also, it is stated in this document that the retention of the attachment member is accomplished substantially by gravity, under the effect of its own weight and especially of the weight of the additional elements that it carries, so that this attachment member has the same drawbacks as the rigid members described above, namely a risk of detachment, and even of throwing, when the beacon is reversed.

SUMMARY

This section provides a general summary of the disclosure and is not a comprehensive disclosure of its full scope or all of its features.

The present disclosure provides an attachment system adapted to remain in place on a signaling barrier (which is raised and lowered) and also on a signaling beacon, even in the event of a fall or throw of the signaling beacon or in the event of impact by a vehicle (or a pedestrian or an animal) on the signaling beacon, or in environments with reduced or zero gravity (such as for example in the context of spacecraft missions).

The present disclosure also provides an attachment system adapted to be attached to different types and/or different sizes of signaling devices, and in particular to signaling barriers with a cylindrical section, signaling cones and to signaling cylindrical beacons. The benefit is then to be able to use the same attachment system for several types and/or sizes of signaling devices.

The present disclosure also provides an attachment system adapted to attach one or several additional element(s) to a signaling device, with an illustrative, and non-limiting application for attaching one or several electronic case(s) to a signaling device in order to provide one or several electronic function(s) such as detection of an event, radio communication, emission of an audible or light signal, etc.

The present disclosure also provides an attachment system with a reduced manufacturing cost, and also with a simple and quick use for operators who will have to install attachment systems on numerous signaling devices. For example, law-enforcement forces, (highway) road agents or emergency services might have to very quickly implement a barrier of cones following an accident. The stress caused by road accidents requires the implementation of extremely simple solutions to implement.

The present disclosure also provides an attachment device in a position chosen by the user so as not to hinder the reflective strips desired for good safety of the cone, in particular when used on roads or highways.

The present disclosure also provides an attachment system that could be stored quickly and with minimum space, whether for example in an intervention van or in a bag carried by intervention agents. The present disclosure uses an elastic attachment support which could therefore be folded easily in a constrained space, and which could regain its shape during use.

The present disclosure also provides an attachment system that is as light as possible in order to allow as widest use as possible, in particular in emergency interventions. For example, it might be emergency beaconing following an accident on the road by firefighters or the police.

The present disclosure also provides an attachment system which is durable, in particular in the event of exposure to very cold temperatures. Indeed, it is known that certain signaling beacons break up upon impacts when the temperatures are cold. Indeed, one of the shortcomings of rigid attachments is the modification of their mechanical properties at low or high temperatures, thus causing breakage during a fall or impact, resulting in a replacement or possibly representing a danger.

The present disclosure provides an attachment system for attachment to a signaling device, such as a signaling beacon or a signaling barrier. The attachment system comprises an attachment member with a generally ring-shape made of an elastic material of the elastomer type. The attachment member comprises an annular base and at least one fin. The annular base is provided with an external peripheral edge and a central orifice defining an internal peripheral edge. The annular base is also provided with an annular lower face and an annular upper face. The fin projects from the external peripheral edge of the annular base. The attachment member is configurable between a rest configuration in which the annular base is planar and extends in a main plane to allow for an insertion and a positioning on the signaling device at a chosen position, and a deformed configuration in which the annular base is non-planar in a deformed state in order to be able to match a peripheral area of the signaling device.

Thus, the attachment member of the present disclosure is flexible and stretchable and may therefore match and elastically enclose the signaling device, thus providing a stable and durable fastening even in the event of displacement of the signaling device, such as for example in the event of a fall or throw of the signaling beacon, or in the event of impact by a vehicle on the beacon or the signaling barrier, or during the multiple opening and closing movements of the signaling barrier.

The attachment system makes it possible to, starting from a rest configuration of the attachment member, insert the annular base from above the signaling device by pulling on the fin(s) so as to stretch the annular base, which is planar at rest, and thus widen the central orifice. The lowering of the attachment member is easy because the friction between the annular base and the device is limited to the contact surface provided by the internal peripheral edge. Then, on completion of mounting, the attachment member is in a deformed configuration with the annular base which is in a deformed state to match the peripheral area of the signaling device with its annular lower face being fully pressed against the peripheral area. Thus, the contact surface between the annular lower face and the peripheral area of the signaling device combined with the elastic tightening together contribute to stable and effective fastening with a very reduced or zero risk of unhooking in the event of fall or throw of the signaling device.

Due to the elastic nature of the attachment member, the fin(s) will therefore be used for placing it around the signaling device allowing it to be pulled so that the annular base is pressed against the signaling device.

At rest, before mounting on the signaling device, the annular base is thus flat, which allows for an easy insertion with little or no friction. Thus, at the beginning of mounting, all the attachment member needs is to stretch the annular base by means of the fin(s) and push down the annular base, which remains flat until reaching the desired position. Once the suitable position has been reached on the signaling device, generally when the internal peripheral edge of the annular base is properly tightened around the signaling device, the operator simply has to release the fin(s) (by pulling slightly downwards or sideways where desired) so that the annular lower face of the annular base is pressed against a peripheral area of the signaling device.

Thus, upon completion of the mounting, the annular base is in a deformed, non-planar state, to match the peripheral area of the signaling device with its annular lower face being fully pressed against the peripheral area and with its annular upper face facing outwards. The contact surface between the annular lower face and the peripheral area combined with the elastic tightening together contribute to a stable and effective fastening with a very reduced or zero risk of unhooking in the event of displacement (fall or throw of the signaling device). In other words, the contact surface between the annular lower face and the peripheral area are fastened with enough force to inhibit the attachment system from falling or becoming a projectile in the event of intended or unintended displacement. The present disclosure thus uses a swivel mechanism between the rest configuration and the deformed configuration, which allows limiting the frictional forces between the attachment member and the signaling device during the installation or removal of the attachment system. The swivel mechanism is folded down against the signaling device when the attachment system is positioned at the location desired by the user. Such a solution allows the user to easily insert the attachment system on the signaling device.

To remove the attachment system, the operator just has to grasp the fin(s) in order to stretch the annular base, then pull upwards to separate the attachment device from the signaling device.

The fin(s) will allow the attachment system to be stretched during set-up but also facilitate removal thereof. The fin(s) advantageously allow(s) using the attachment system with gloves through a contact surface that could be easily gripped by the user. Similarly, in the event of rain or snow or grease splashes, it will be easy for the user to come and remove the device since he will have to stretch and not preempt.

In one form, the fin(s) is/are laterally folded down with respect to the annular upper face of the annular base. Thus, since the fin(s) is/are laterally folded down with respect to the annular upper face of the annular base, once the attachment system is in place on the signaling device, then the fin(s) protrude(s) from the peripheral area of the signaling device without coming into contact therewith. This advantageously allows the fin(s) not to cover the signaling device, and therefore not to hide any reflective strips which are generally provided on the signaling device and which have a very important normative and safety function.

According to another form, the external peripheral edge of the annular base is extended by a peripheral flange laterally folded down with respect to the annular upper face of the annular base, and the fin(s) come(s) in the continuation of said peripheral flange so that the fin(s) is/are laterally folded down with respect to the annular upper face of the annular base.

According to yet another form, the fin(s) is/are laterally folded down with respect to the annular upper face of the annular base at an angle between 70 and 110 degrees, which will allow the fin(s) to extend horizontally, at more or less 20 degrees once the attachment system is in place on the signaling device.

According to one form, the central orifice of the annular base is circular, so that the internal peripheral edge is cylindrical. Nevertheless, the central orifice of the annular base may have other shapes, such as for example a polygonal shape (square, hexagonal, etc.), an ovoid shape, an oblong shape, or an irregular shape.

According to another form, the external peripheral edge is cylindrical. Nevertheless, this external peripheral edge may have other shapes, such as for example a polygonal shape (square, hexagonal, etc.), an ovoid shape, an oblong shape, or an irregular shape.

According to yet another form, the attachment system comprises at least two fins, and for example at least two fins which are diametrically opposed. The use of at least two fins makes it possible to place/remove the attachment system with both hands for greater ease and speed.

According to one form, the attachment system comprises four fins with two diametrically opposed fins and two other diametrically opposed fins.

According to another form, the elastic material is an elastomer of the silicone material type. The elastomer may also be a natural elastomer, such as a rubber, for example, or a synthetic elastomer, such as an elastomeric polymer such as a silicone material. The silicone material is advantageous because it has a friction coefficient that is quite high for an effective resistance, as well an excellent resistance to cold temperatures and preservation over time of elastic, friction and adhesion properties.

According to yet another form, the elastic material has an elongation rate comprised between 300 and 900%.

According to one form, the elastic material is a transparent or translucent material, which makes it possible not to hinder the visibility of any reflective bands which are generally provided on the signaling device, in particular in the event where the attachment system covers, in all or in part, the reflective strips of the signaling device. As an example, the elastic material is an optical grade silicone material.

According to another form, the elastic material may be fluorescent, reflective or phosphorescent. For example, it may be useful, in a construction site, to increase the visibility of a cone. The present disclosure may then be used to simply and quickly increase the visibility of the signaling device. A variant will consist in using an elastic material reacting to UV light. As a result, it may be advantageous to only allow visibility to some users (those equipped with a UV lamp) and not to others. The upper position is then advantageous to allow for good visibility. The grip offered by the use of an elastic material makes it possible to transport the raised cone from place A to place B without having to remove the attachment system. Another variant may be the use of a display or flexible screen (for example of the OLED, AMOLED type or other technologies of flexible screen) integrated into all or part of the elastomer attachment surface allowing for example displaying a specific message, to show a color to warn about a state (red, green, orange, etc.) or to flash in white or another color to produce an alert.

According to yet another form, LED strips may be integrated into all or part of the attachment surface.

According to one form, Braille characters may be integrated on the outer surface of the attachment system, thus allowing a blind or visually impaired person to be able to understand the nature of the risk or the danger materialized by one or several signaling beacon(s) put in place. The user with a disability could thus touch the top of the signaling device to obtain information.

According to another form, the fins are provided with recessed or protruding reliefs to facilitate holding and gripping by an operator.

According to yet another form, the fins are provided with at least one through hole (for example a hole that is oblong, round or of any other shape) in order to allow several signaling beacons to be connected together with a flexible link such as for example a visual signaling strip.

According to one form, at least one fin is equipped with a deformation or stretching sensor. Thus, the flexible material of the fin may receive (thereinside or thereoutside) a deformation or stretching sensor (such as a piezoelectric sensor, a resistive sensor, a capacitive sensor) in order to detect whether the attachment system has been removed, impacted, cut or manipulated. The deformation or stretching sensor may advantageously be linked to an electronic case connected to the attachment system or external to the latter. The deformation or stretching sensor thus makes it possible to add in more safety to the beaconing and protection of a dangerous or prohibited area (for example, in the case of a police investigation or a crime area) through the use of a strip or a cable attached to the attachment device fins integrated into different beacons. The tension of the strip or cable will then be measured and transmitted to an electronic device, either internal or external.

According to another form, at least one fin supports one or several photovoltaic cell(s), thus making it possible to integrate a photovoltaic capacity to recover energy when the signaling device is exposed to the Sun.

According to yet another form, the attachment system comprises at least one connector fastened to the attachment member for connecting an additional element such as an electronic case to the attachment member. The connector thus allows the addition of functionalities to the signaling device, via the attachment system. The connector may be at least partially rigid (in other words totally or partially rigid) or at least partially elastic (in other words totally or partially elastic), and the connector may be secured to the attachment member, for example by overmolding, welding, etc. For example, this connector allows fastening an electronic case that is independent or connected to other electronic cases mounted on other signaling devices (for example via conductive strips or cables integrated in the annular base). Thus, at least one electronic case could be connected after the set-up of the attachment system on the signaling device, which makes it possible to preserve the attachment system while increasing the functional capabilities of the signaling device.

According to one form, the connector is in the form of a flexible elastomer shell allowing easy insertion or removal of the electronic case, while protecting it from possible impacts or falls. Such a connector may for example be made of the same transparent or translucent material, making it possible to leave one or several connector(s) empty without forming an optical hindrance. The flexible nature of the connector allows the attachment system to be folded and stored without this being a hindrance for the user.

According to another form, the flexible shell may have an opening on the side to let through a polarizer and a pin-type locking system.

According to yet another form, at least one connector of the flexible shell type may be located between two fins. Also, it is possible to have four connectors placed between the fins if four fins are provided on the attachment system.

According to one form, the connector comprises a tab. Advantageously, the tab extends substantially parallel to the annular base facing the annular upper face. The fact of extending parallel to the annular base allows the tab to be initially flat (in the rest configuration of the attachment member) then it will follow the deformation of the annular base to find itself pressed against the signaling device once the set-up has been completed. This makes it possible to have a reduced bulk while facilitating installation. The additional element(s), electronic or not, may be fastened to the tab before or after set-up.

According to another form, the connector is provided with a clipping element facilitating the connection of the additional element.

According to yet another form, the connector is fastened on the annular base or on the previously described peripheral flange.

According to one form, the connector integrates at least one inner electronic element and/or at least one electrical connection and/or at least one electrical wiring.

According to another form, a flexible electronic device is integrated on or in the attachment member, such as for example a flexible antenna. Thus, the electronics, typically flexible electronics, may also be in or on the attachment device. Given the shape of the attachment member, a flexible antenna may be interesting if it is desired to transform the signaling device into a kind of relay antenna allowing "mesh" type point-to-point links or telecom relays of the LAN/WAN type. The position of the attachment system makes it possible to benefit from an ideal position given the constraints of propagation of electromagnetic waves.

According to yet another form, the electronic device is integrated directly into the attachment system. Thus, in this case, the user no longer has the need to come and position the electronic device by himself. A variant of this form consists in having a portion of the electronics integrated into the attachment system and one or several other portion(s) that might be added later by the user according to the capabilities he wishes to add. Thus, it is possible to easily offer a wireless connection allowing for exchanges between the different portions or the use of metallic inks or cables to make signals or a power supply transit between the different portions.

The present disclosure also relates to a signaling system comprising a signaling device, such as for example a signaling beacon or a signaling barrier, and an attachment system according to the present disclosure, wherein the attachment member is attached in a deformed configuration to the signaling device by having its annular base mounted around a peripheral area of the signaling device. The annular base being in a deformed state so as to have its annular lower face fully pressed against the peripheral area of the signaling device, and its annular upper face facing outwards. Advantageously, the fin(s) is/are laterally folded down with respect to the annular upper face of the annular base, so that the fin(s) protrude(s) from the peripheral area of the signaling device without coming into contact therewith. As previously described, it is advantageous that the fin(s) extend(s) horizontally (for a beacon) or vertically (for a barrier), at more or less 20 degrees once the attachment member is attached to the signaling device.

The present disclosure also relates to an attachment method for attaching an attachment system to a signaling device such as a signaling beacon or a signaling barrier. The attachment system being in accordance with the present disclosure, and such an attachment method comprising the following steps: starting from a rest configuration of the attachment member, the annular base is inserted around the signaling device by pulling on the fin(s) so as to stretch the annular base which remains planar in order to widen the central orifice and to move the attachment member to a desired position; and the attachment member is tilted towards its deformed configuration with the annular base which reaches a deformed state to match a peripheral area of the signaling device with its annular lower face being fully pressed against said peripheral area of the signaling device.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
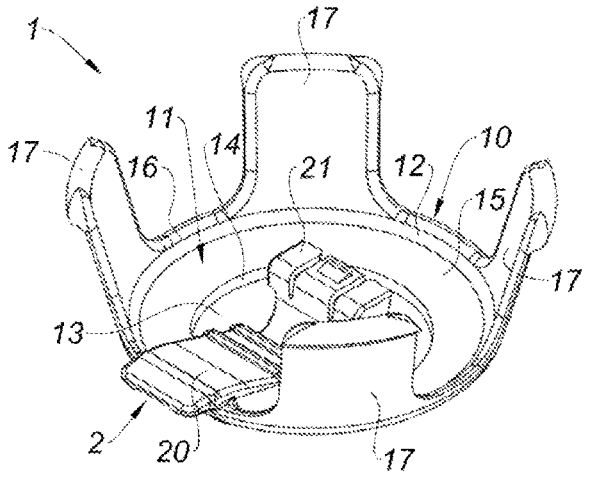
FIG. 1 is a perspective view of an attachment system according to the principles of the present disclosure with an attachment member in a rest configuration and with a connector provided with a clipping element.
Figure 2:
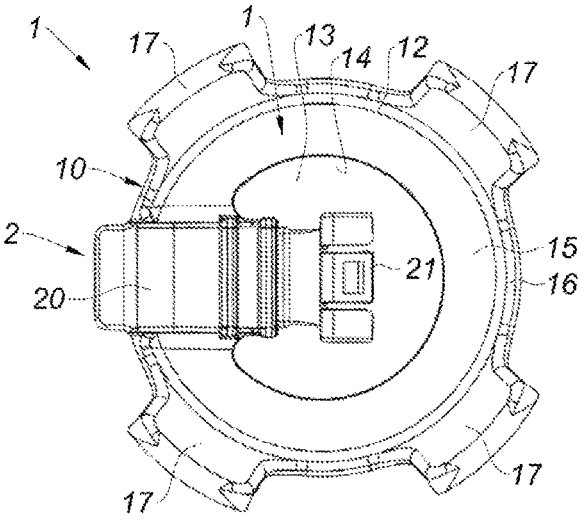
FIG. 2 is a perspective top view of the attachment system of FIG. 1 with the attachment member in the rest configuration and with the connector provided with its clipping element.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 9:
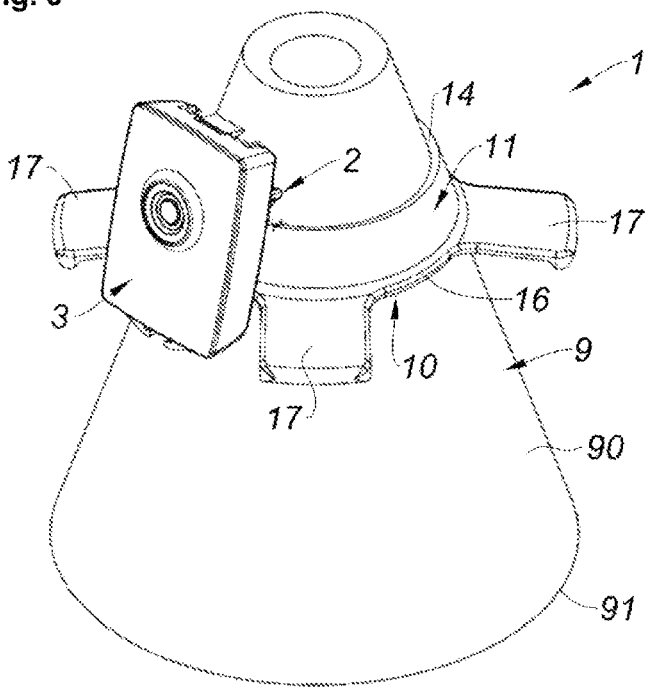
FIG. 9 is a perspective view of a signaling system according to the principles of the present disclosure comprising a signaling beacon of the signaling cone type and comprising the attachment system shown in FIGS. 7 and 8 with the attachment member in the deformed configuration and with the electronic case fastened to the clipping element of the connector.
Figure 10:
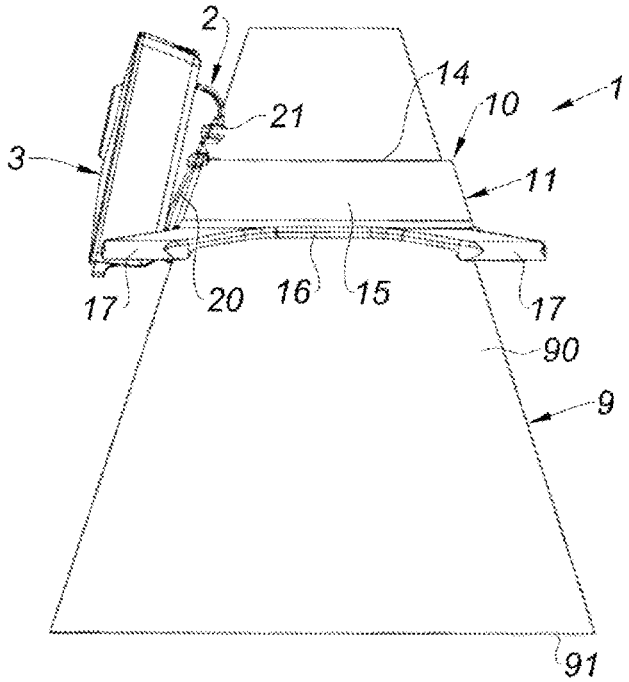
FIG. 10 is a perspective side view of the signaling system of FIG. 9.

With reference to FIGS. 1-10, an attachment system 1 according to one form of the present disclosure is provided for attachment to a signaling device 9 such as for example a signaling beacon (FIGS. 9 and 10) such as a signaling beacon of the signaling cone or cylindrical signaling beacon type. For the rest of the description, the signaling device 9 will be described as being a signaling beacon (bearing the same reference "9") of the signaling cone type as illustrated in FIGS. 9 and 10 with a frustoconical shaped hollow body 90 (possibly provided with reflective strips) terminating in a support base 91 on the ground.

The attachment system 1 comprises an attachment member 10 with a ring-like general shape and made, in one piece, of an elastic material in particular of an elastomer such as a silicone material having an elongation rate comprised between 300 and 900% and a shore-A hardness comprised between 10 and 90, and in particular between 20 and 50.

The attachment member 10 comprises an annular base 11 provided with an external peripheral edge 12 and a central orifice 13 defining an internal peripheral edge 14. The annular base 11 is in the form of a disk with its cylindrical (or circular) external peripheral edge 12 and with the central orifice 13 which is circular so that the internal peripheral edge 14 is cylindrical (or circular).

The annular base 11 is thin, to the extent that it has a small thickness compared to the diameters of the external peripheral edge 12 and of the internal peripheral edge 14. The annular base 11 is provided with two opposite annular faces, namely an annular lower face 19 (shown in FIGS. 3, 4, 6 and 7) and an annular upper face 15.

In a rest configuration of the attachment member 10, as illustrated in FIGS. 1-3 and 5, the annular base 11 is planar and extends in a main plane.

Figure 3:
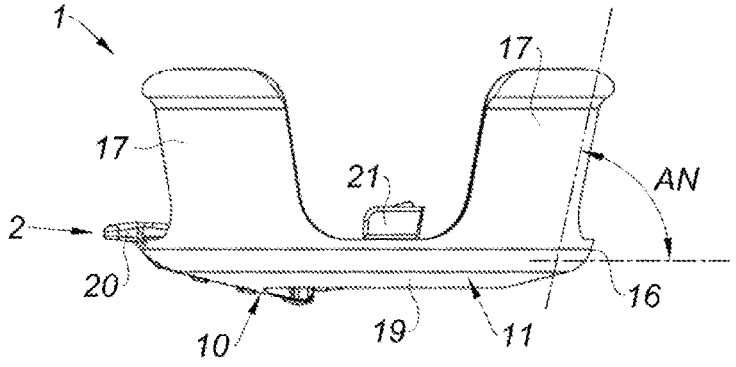
FIG. 3 is a perspective side view of the attachment system of FIG. 1 with the attachment member in the rest configuration and with the connector provided with its clipping element.
Figure 4:
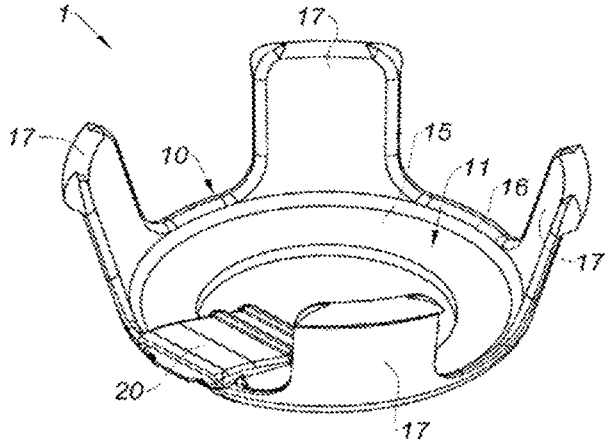
FIG. 4 is a perspective view of the attachment system of FIG. 1 with the attachment member in the rest configuration and with the connector provided with its clipping element.
Figure 5:
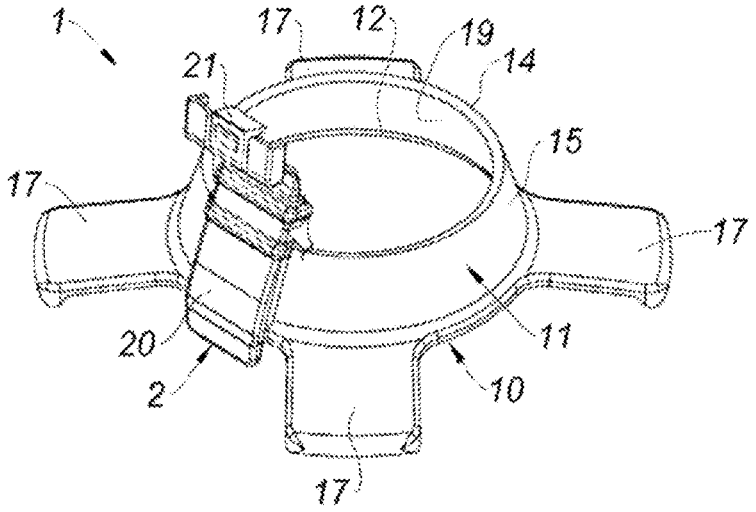
FIG. 5 is a perspective view of the attachment system of FIG. 1 with the attachment member in a deformed configuration and with the connector provided with its clipping element.
Figure 6:
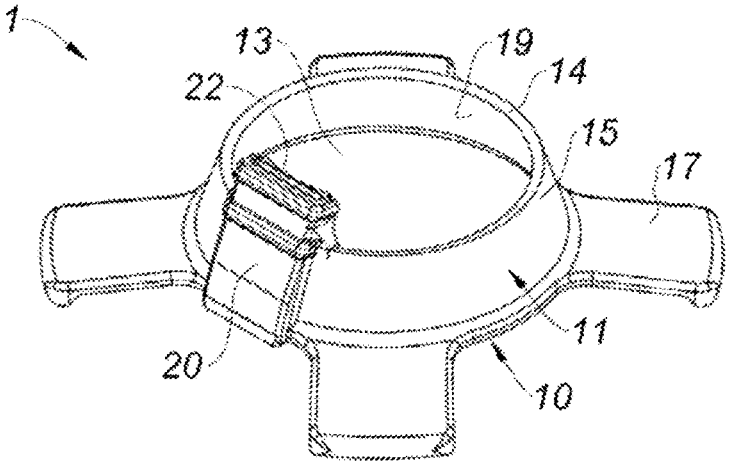
FIG. 6 is a perspective view of the attachment system of FIG. 1 with the attachment member in a deformed configuration and with the connector devoid of its clipping element.
Figure 7:
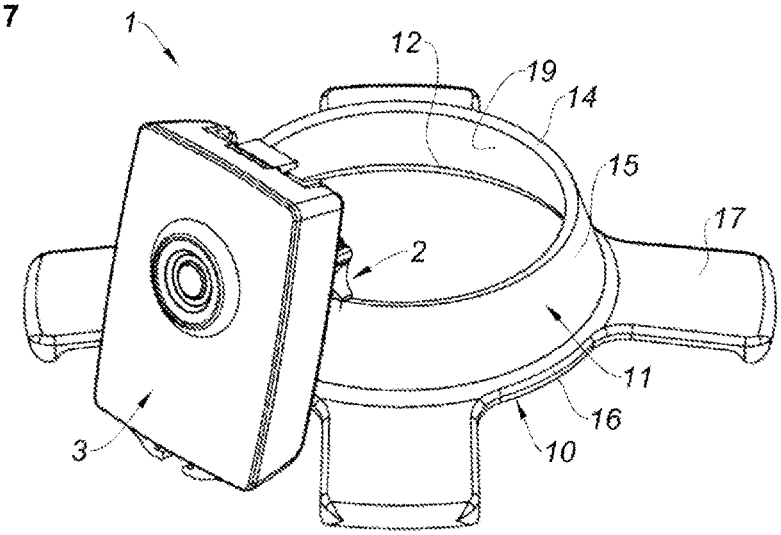
FIG. 7 is a perspective view of the attachment system of FIG. 1 with the attachment member in the deformed configuration and with an electronic case fastened to the clipping element of the connector.
Figure 8:
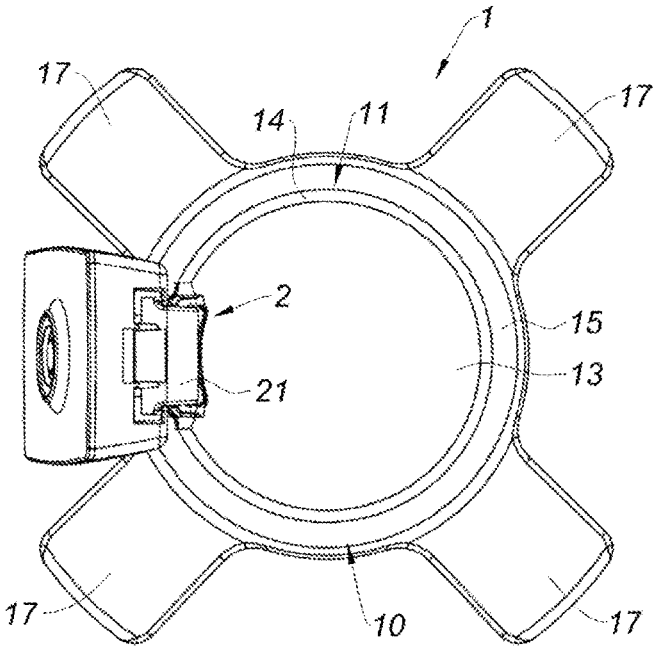
FIG. 8 is a perspective top view of the attachment system of FIG. 1 with the attachment member in the deformed configuration and with the electronic case fastened to the clipping element of the connector.

The external peripheral edge 12 of the annular base 11 is extended by a peripheral flange 16 laterally folded down with respect to the annular upper face 15 of the annular base 11 according to an angle AN between 70 and 110 degrees (FIG. 3).

Moreover, the attachment member 10 comprises several fins 17 which come in the continuation of the peripheral flange 16, so that the fins 17 are laterally folded down with respect to the annular upper face 15 of the annular base 11, according to an angle between 70 and 110 degrees.

Also, the fins 17 project from the external peripheral edge 12 of the annular base 11, further project from the peripheral flange 16, and the fins 17 further protrude upwards from the annular upper face 15 of the annular base 11 in the rest configuration of the attachment member 10.

In the illustrated example, the fins 17 are four in number, and they are distributed 90 degrees from each other, therefore with two diametrically opposed fins 17 and two other diametrically opposed fins 17, thus conferring on the fins 17 a cross-like shape.

The attachment system 1 further comprises at least one connector 2 fastened to the attachment member 10 to connect to the attachment member 10 an additional element, such as an electronic case 3 (FIGS. 7 to 10).

The connector 2 comprises a tab 20 which extends substantially parallel to the annular base 11 facing the annular upper face 15 in the rest configuration of the attachment member 10. The tab 20 is integrally made with the attachment member 10 and is therefore also made of an elastic material. The tab 20 is fastened to and protrudes from the peripheral flange 16, between two fins 17.

The connector 2 is provided with a clipping element 21 which is fastened to the tab 20, in particular in a hole 22 (FIG. 6) formed in the tab 20. The clipping element 21 is a rigid element, for example made of a thermoplastic material, which may form a male or female clipping element.

Thus, the electronic case 3 is provided with a clipping element complementary to the clipping element 21, for a clip-on fastening of the electronic case 3 on the connector 2 and therefore on the attachment system 1. The attachment system 1 being itself ultimately attached to the signaling beacon 9.

The mounting of the attachment system 1 on the signaling beacon 9 is carried out as follows, starting from a rest configuration of the attachment member 10. In the rest configuration, the annular base 11 is flat, and thus the operator holds the attachment system 1 at the level of the fins 17 and he pulls on the fins 17 to stretch the annular base 11 and thus widen the central orifice 13. The operator then inserts the annular base 11 around the signaling beacon 9 by introducing the top of the signaling beacon 9 into the central orifice 13, and lowers the attachment member 10, which is easy because the friction between the annular base 11 is then limited to the contact surface offered by the internal peripheral edge 14.

Once the suitable position has been reached on the signaling beacon 9, the operator releases the fins 17 (by pulling slightly downwards where desired) so that the annular lower face 19 of the annular base 11 is pressed against a peripheral area of the signaling beacon 9.

Thus, upon completion of mounting, the attachment member 10 is in a deformed configuration with the annular base 11 which is in a deformed state to match the peripheral area of the signaling beacon 9, with its annular lower face 19 being fully pressed against the peripheral area and with its annular upper face 15 facing outwards. In the case of a signaling cone 9, the annular base 11 therefore finds itself in this deformed state with a frustoconical general shape. In the case of a cylindrical signaling beacon, the annular base 11 would therefore find itself in this deformed state with a cylindrical general shape.

The contact surface between the annular lower face 19 and the peripheral area of the signaling beacon 9 combined with the elastic tightening together contribute to a stable and effective fastening with a very reduced or zero risk of unhooking in the event of a fall or throwing of the signaling beacon 9.

Moreover, the fins 17 being laterally folded down with respect to the annular upper face 15 of the annular base 11 protrude from the peripheral area of the signaling beacon 9 without coming into contact therewith, and these fins 17 extend horizontally, at more or less 20 degrees.

Furthermore, the tab 20 has followed the deformation of the annular base 11 and this tab 20 finds itself pressed against the signaling beacon 9, so that the connector 2 and the electronic case 3 are both pressed against the signaling beacon 9.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An attachment system for attachment to a signaling device, the attachment system comprising:

an attachment member with a ring-shape made of an elastic material, the attachment member comprising:

an annular base provided with an external peripheral edge and a central orifice defining an internal peripheral edge, the annular base also being provided with an annular lower face and an annular upper face; and at least one fin projecting from the external peripheral edge of the annular base, wherein the attachment member is movable between a rest configuration in which the annular base is planar and extends in a main plane to allow insertion and positioning on the signaling device at a selected position, and a deformed configuration in which the annular base is non-planar in a deformed state in order to be able to match a peripheral area of the signaling device.

2. The attachment system according to claim 1, wherein the at least one fin is laterally folded down with respect to the annular upper face of the annular base.

3. The attachment system according to claim 2, wherein the external peripheral edge of the annular base is extended by a peripheral flange laterally folded down with respect to the annular upper face of the annular base, and wherein the at least one fin comes in a continuation of said peripheral flange so that the at least one fin is laterally folded down with respect to the annular upper face of the annular base.

4. The attachment system according to claim 2, wherein the at least one fin is laterally folded down with respect to the annular upper face of the annular base at an angle between 70 and 110 degrees.

5. The attachment system according to claim 1, wherein the at least one fin comprises at least two fins, and the at least two fins are diametrically opposed.

6. The attachment system according to claim 5, wherein the at least one fin comprises four fins, and wherein a first set of two fins of the four fins are diametrically opposed and a second set of two fins of the four fins are diametrically opposed.

7. The attachment system according to claim 1, wherein the elastic material is a silicone material.

8. The attachment system according to claim 1, wherein the elastic material has an elongation rate between 300 and 900%.

9. The attachment system according to claim 1, wherein the elastic material is a transparent or translucent material.

10. The attachment system according to claim 1, further comprising at least one connector fastened to the attachment member for connecting to the attachment member an additional element.

11. The attachment system according to claim 10, wherein the at least one connector comprises a tab.

12. The attachment system according to claim 11, wherein the tab extends substantially parallel to the annular base facing the annular upper face.

13. The attachment system according to claim 10, wherein the connector comprises a clipping element.

14. The attachment system according to claim 10, wherein the external peripheral edge of the annular base is extended by a peripheral flange laterally folded down with respect to the annular upper face of the annular base, and wherein the connector is fastened on the annular base or on the peripheral flange.

15. A signaling system comprising:

a signaling device; and the attachment system according to claim 1, where the attachment member is attached in the deformed configuration to the signaling device with the annular base being mounted around the peripheral area of the signaling device, the annular base being in the deformed state to have the annular lower face fully pressed against the peripheral area of the signaling device, and the annular upper face facing outwards.

16. The signaling system according to claim 15, wherein the at least one fin is laterally folded down with respect to the annular upper face of the annular base, and wherein the at least one fin protrudes from the peripheral area of the signaling device without coming into contact with the peripheral area.

17. The signaling system according to claim 16, wherein the at least one fin is laterally folded down with respect to the annular upper face of the annular base at an angle between 70 and 110 degrees.

18. An attachment method for attaching an attachment system according to claim 1 to a signaling device, the attachment method comprising the following steps:

starting from the rest configuration of the attachment member, inserting the annular base around the signaling device by pulling on the at least one fin so as to stretch the annular base which remains planar in order to widen the central orifice and to displace the attachment member to a desired position; and tilting the attachment member towards the deformed configuration with the annular base which reaches the deformed state to match the peripheral area of the signaling device with the annular lower face being completely pressed against the peripheral area of the signaling device.

* * * * *